US008553893B2

(12) United States Patent
Katayama et al.

(10) Patent No.: US 8,553,893 B2
(45) **Date of Patent: *Oct. 8, 2013**

(54) SOUND PROCESSING DEVICE, SPEAKER APPARATUS, AND SOUND PROCESSING METHOD

(75) Inventors: Masaki Katayama, Hamamatsu (JP); Naoya Moriya, Hamamatsu (JP)

(73) Assignee: Yamaha Corporation (JP)

( * ) Notice: Subject to any disclaimer, the term of this patent is extended or adjusted under 35 U.S.C. 154(b) by 348 days.

This patent is subject to a terminal disclaimer.

(21) Appl. No.: 12/482,140

(22) Filed: Jun. 10, 2009

(65) Prior Publication Data

US 2009/0304186 A1 Dec. 10, 2009

(30) Foreign Application Priority Data

Jun. 10, 2008 (JP) ..... P. 2008-152041

(51) Int. Cl.
*H04R 5/00* (2006.01)
*H04R 1/40* (2006.01)

(52) U.S. Cl.
USPC ..... 381/17; 381/97

(58) Field of Classification Search
USPC ..... 381/17, 18, 1, 300, 310, 80, 89, 309, 381/97, 61, 63
See application file for complete search history.

(56) References Cited

U.S. PATENT DOCUMENTS

| | | | | |
|---|---|---|---|---|
| 6,771,778 | B2 * | 8/2004 | Kirkeby | 381/17 |
| 6,804,358 | B1 * | 10/2004 | Kawano | 381/17 |
| 2004/0136554 | A1 * | 7/2004 | Kirkeby | 381/309 |

(Continued)

FOREIGN PATENT DOCUMENTS

| | | | |
|---|---|---|---|
| JP | 9-114479 | A | 5/1997 |
| JP | 10-28097 | A | 1/1998 |
| JP | 2003153398 | A | 5/2003 |
| WO | 2006076926 | A2 | 7/2006 |

OTHER PUBLICATIONS

International Search Report issued on Oct. 30, 2009 of the corresponding EP Patent Application No. 09007707.4. Full Translation.

*Primary Examiner* — Mohammad Islam
*Assistant Examiner* — David Ton
(74) *Attorney, Agent, or Firm* — Rossi, Kimms & McDowell LLP

(57) ABSTRACT

A sound processing device includes an inputting section which inputs L-ch audio data and R-ch audio data, a delaying section which applies a delaying process to the L-ch audio data and the R-ch audio data for a delay time that is set in a range from 62.5 microsecond to 125 microsecond, an adding section which adds the delayed L-ch audio data to the inputted L-ch audio data, and which adds the delayed R-ch audio data to the inputted R-ch audio data, a phase adjusting section which adjusts a phase of the added L-ch audio data into a phase that is different from a phase of the input L-ch audio data, and which adjusts a phase of the added R-ch audio data into a phase that is different from a phase of the inputted R-ch audio data, and an outputting section which adds the L-ch audio data whose phase is adjusted by the phase adjusting section to the inputted R-ch audio data and outputs resultant R-ch audio data, and which adds the R-ch audio data whose phase is adjusted by the phase adjusting section to the inputted L-ch audio data and outputs resultant L-ch audio data.

8 Claims, 6 Drawing Sheets

(56) References Cited

U.S. PATENT DOCUMENTS

2006/0115090 A1* 6/2006 Kirkeby ..... 381/17
2006/0126871 A1* 6/2006 Yamada et al. ..... 381/309
2007/0076892 A1* 4/2007 Kim ..... 381/17
2008/0031462 A1* 2/2008 Walsh et al. ..... 381/17
2008/0118072 A1* 5/2008 Tsutsui et al. ..... 381/17
2009/0262947 A1* 10/2009 Karlsson et al. ..... 381/17
2010/0166190 A1* 7/2010 Aarts ..... 381/1

* cited by examiner

SOUND PROCESSING DEVICE, SPEAKER APPARATUS, AND SOUND PROCESSING METHOD

BACKGROUND

The present invention relates to the technology to expand sound image positions of respective speakers in stereo sound reproduction.

Two speakers for L-ch and R-ch are provided to the speaker apparatus that can reproduce the sound in stereo. When the electronic equipment to which such speakers are provided is a small-sized device, e.g., mobile terminal, small-sized TV, or the like, or when the case intended for portability or space saving is employed, or the like, an interval between two speakers cannot be set widely. In this case, when an interval between two speakers is narrow in this manner, though a wide spreading sound field can be obtained by the stereo sound reproduction compared to the monaural sound reproduction, a center-spread angle between speaker positions in viewed from a listener becomes narrow, and also the obtained wide spreading sound field becomes narrow.

Therefore, the technology to extend a sound field artificially by applying a sound process even when an interval between two speakers is narrow has been developed. For example, in Patent Literature 1, the technology to add a delayed signal obtained by delaying a signal on one channel to a signal on the other channel is disclosed. Also, in Patent Literature 2, the technology using HRTF (Head-Related Transfer Function) is disclosed.

[Patent Literature 1] JP-A-10-28097

[Patent Literature 2] JP-A-09-114479

In the technology disclosed in Patent Literature 1, sound images can be expanded, but localization of sounds is lost because such sound images expand in a blurred fashion. In Patent Literature 2, the process such as the FIR (Finite Impulse Response) filter, or the like is needed, and also a huge amount of process is needed. Also, the localization of sounds can be created precisely by using the HRTF, nevertheless in some cases unnatural localization of sounds is created depending on the listener because a shape of the listener's head is different individually.

SUMMARY

The present invention has been made in view of the above circumstances, and it is an object of the present invention to provide a sound processing device, a speaker apparatus and, a sound processing method, capable of expanding sound image positions of respective speakers in a small processed amount without deteriorating the localization of sounds even when an interval between two speakers is narrow.

In order to solve the above problem, the present invention provides sound processing device, comprising:

an inputting section which inputs L-ch audio data and R-ch audio data;

a delaying section which applies a delaying process to the L-ch audio data and the R-ch audio data for a delay time that is set in a range from 62.5 microsecond to 125 microsecond;

an adding section which adds the L-ch audio data delayed by the delaying section to the L-ch audio data being input by the inputting section, and which adds the R-ch audio data delayed by the delaying section to the R-ch audio data being input by the inputting section;

a phase adjusting section which adjusts a phase of the L-ch audio data added by the adding section into a phase that is different from a phase of the L-ch audio data being input by the inputting section, and which adjusts a phase of the R-ch audio data added by the adding section into a phase that is different from a phase of the R-ch audio data being input by the inputting section; and an outputting section which adds the L-ch audio data whose phase is adjusted by the phase adjusting section to the R-ch audio data being input by the inputting section and outputs resultant R-ch audio data, and which adds the R-ch audio data whose phase is adjusted by the phase adjusting section to the L-ch audio data being input by the inputting section and outputs resultant L-ch audio data.

Also, the present invention provides a sound processing device, comprising:

an inputting section which inputs L-ch audio data and R-ch audio data;

a filter processing section which has a frequency characteristic in which a lowest frequency of a dip is set in a range from 4 kHz to 8 kHz, and applies a filter process to the L-ch audio data and the R-ch audio data;

a phase adjusting section which adjusts a phase of the L-ch audio data, which is subjected to the filter process from the filter processing section, into a phase that is different from a phase of the L-ch audio data being input by the inputting section, and adjusts a phase of the R-ch audio data, which is subjected to the filter process from the filter processing section, into a phase that is different from a phase of the R-ch audio data being input by the inputting section; and an outputting section which adds the L-ch audio data whose phase is adjusted by the phase adjusting section to the R-ch audio data being input by the inputting section and outputs resultant R-ch audio data, and adds the R-ch audio data whose phase is adjusted by the phase adjusting section to the L-ch audio data being input by the inputting section and outputs resultant L-ch audio data.

Preferably, the phase adjusting section adjusts the phase of the L-ch audio data added by the adding section into the phase that is inverted in phase from the phase of the L-ch audio data being input by the inputting section, and adjusts the phase of the R-ch audio data added by the adding section into the phase that is inverted in phase from the phase of the R-ch audio data being input by the inputting section.

Preferably, the filter processing means includes either a comb filter, a notch filter, or a parametric equalizer.

Preferably, the sound processing device further includes a controlling section which decides the delay time being set in the delaying section, in response to an instruction.

Also, the present invention provides a speaker apparatus, comprising:

the sound processing device described above;

a converting section which converts the resultant R-ch audio data and the resultant L-ch audio data into analog signals, and outputs an R-ch audio signal and an L-ch audio signal;

an amplifying section which amplifies the R-ch audio signal and the L-ch audio signal respectively; and an L-ch speaker and an R-ch speaker which emit the R-ch audio signal and the L-ch audio signal amplified by the amplifying section respectively.

Also, the present invention provides sound processing method, comprising:

an inputting process of inputting L-ch audio data and R-ch audio data;

a delaying process of applying a delaying process to the L-ch audio data and the R-ch audio data for a delay time that is set in a range from 62.5 microsecond to 125 microsecond;

an adding process of adding the L-ch audio data delayed by the delaying process to the L-ch audio data being input by the inputting process, and adding the R-ch audio data delayed by the delaying section to the R-ch audio data being input by the inputting process;

a phase adjusting process of adjusting a phase of the L-ch audio data added by the adding process into a phase that is different from a phase of the L-ch audio data being input by the inputting process, and adjusting a phase of the R-ch audio data added by the adding process into a phase that is different from a phase of the R-ch audio data being input by the inputting process; and an outputting process of adding the L-ch audio data whose phase is adjusted by the phase adjusting process to the R-ch audio data being input by the inputting process and outputting resultant R-ch data, and adding the R-ch audio data whose phase is adjusted by the phase adjusting process to the L-ch audio data being input by the inputting process and outputting resultant R-ch data.

Also, the present invention provides a sound processing method, comprising:

an inputting process of inputting L-ch audio data and R-ch audio data;

a filter processing process of applying a filter process, having a frequency characteristic in which a lowest frequency of a dip is set in a range from 4 kHz to 8 kHz, to the L-ch audio data and the R-ch audio data;

a phase adjusting process of adjusting a phase of the L-ch audio data, which is subjected to the filter process from the filter processing process, into a phase that is different from a phase of the L-ch audio data being input by the inputting process, and adjusting a phase of the R-ch audio data, which is subjected to the filter process from the filter processing process, into a phase that is different from a phase of the R-ch audio data being input by the inputting process; and an outputting process of adding the L-ch audio data whose phase is adjusted by the phase adjusting process to the R-ch audio data being input by the inputting process and outputting resultant R-ch audio data, and for adding the R-ch audio data whose phase is adjusted by the phase adjusting process to the L-ch audio data being input by the inputting process and outputting resultant L-ch audio data.

According to the present invention, the sound processing device, the speaker apparatus and, the sound processing method, which are capable of expanding sound image positions of respective speakers in a small processed amount without impairing the localization of sounds even when an interval between two speakers is narrow, can be provided.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

An embodiment of the present invention will be explained hereinafter.

Embodiment

Figure 2:
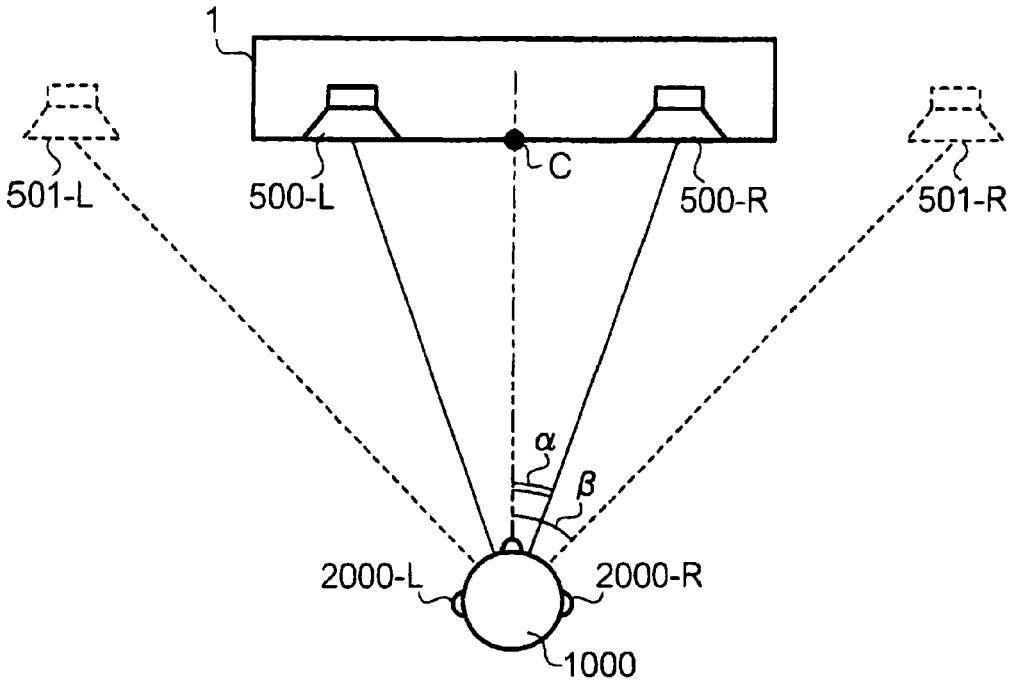
FIG. 2 is an explanatory view showing a relationship between speaker positions of the speaker apparatus and a listener according to the embodiment.

As shown in FIG. 2, a speaker apparatus 1 according to the embodiment of the present invention includes two speakers 500-L, 500-R. The speaker apparatus 1 emits the sound to a listener 1000, and others who position in a front direction of a center C between the speakers 500-L, 500-R (a direction perpendicular to a line connecting the two speakers 500-L, 500-R) in response to input audio data. This speaker apparatus 1 can apply the sound process, described later, to the input audio data such that sound image positions of respective speakers 500-L, 500-R that the listener 1000 perceives (one-side angle $\alpha$, center-spread angle $2\alpha$) are expanded to positions of virtual speakers 501-L, 501-R (one-side angle $\beta$, center-spread angle $2\beta$), for example. First, the case where the sound process is applied to expand the sound image positions by using the HRTF like the prior art will be explained simply, and then the configuration of the speaker apparatus 1 used to implement the sound process in the embodiment of the present invention will be explained hereunder. In this case, explanation will be made hereunder on the assumption that the one-side angle $\alpha$ indicating the actual speakers 500-L, 500-R is set to 20° and the one-side angle $\beta$ indicating the virtual speakers 501-L, 501-R located when the sound image positions are expanded is set to 45°.

In case the HRTF is employed, respective HRTFs from the speakers in respective positions to a right ear 2000-R and a left ear 2000-L are acquired. Here, HRTF of a direct path from the speaker located in the direction at the one-side angle $\alpha$ is referred to as Ha($\alpha$) hereinafter, and HRTF of an indirect path is referred to as Hb($\beta$) hereinafter.

The HRTF of the direct path from the speaker 500-R to the right ear 2000-R (referred to as Ha (20°) hereinafter) is acquired. Also, the HRTF of the indirect path from the speaker 500-R to the left ear 2000-L (referred to as Hb (20°) hereinafter) is acquired. Similarly, Ha (45°) and Hb (45°) are acquired from the speaker located in the position of the virtual speaker 501-R. Here, since the listener 1000 is positioned right in front of the speaker apparatus 1, the HRTFs from the speaker 500-L are similar to those of the speaker 500-R and thus there is no need to acquire them. Also, acquisition of the HRTF may be performed by using the publicly known method. For example, the method using a dummy head may be applied.

The HRTF of a difference between Ha (20°) and Ha (45°) as the HRTF of the direct path (or Ha (45°)-Ha (20°) when dB is used as the unit) is applied to audio data for R-ch and audio data for L-ch respectively. Also, apart from this, the HRTF of a difference between Hb (20°) and Hb (45°) as the HRTF of the indirect path (or Hb (45°)-Hb (20°) when dB is used as the unit) is applied to the audio data for R-ch and the audio data for L-ch respectively.

The sound is emitted from the speaker 500-R based on the audio data that is obtained by adding the audio data for R-ch, to which the HRTF of the difference of the direct path is applied, to the audio data for L-ch, to which the HRTF of the difference of the indirect path is applied. Also, the sound is emitted from the speaker 500-L based on the audio data that is obtained by adding the audio data for R-ch, to which the HRTF of the difference of the direct path is applied, to the audio data for L-ch, to which the HRTF of the difference of the indirect path is applied.

Accordingly, the listener 1000 can perceive the sound emitted from the speaker 500-R as sound emitted from the virtual speaker 501-R. In this case, as described above, the process of applying the HRTF needs a huge amount of calculation, and the load imposed on the system becomes heavy. Also, the HRTFs corresponding to respective listeners must be acquired to reproduce precisely the sound, and thus some listeners whose head is different in shape feel the strange localization of sounds. With the above, explanation of the case using HRTF is completed.

Next, the frequency characteristics of Ha(α) and Hb(β) when α is set to α=20°, 30°, 45°, and 60° respectively are shown in FIGS. 4A to 7B. When α is changed respectively, the frequency characteristics of Ha(α) and Hb(α) are changed in various frequency bands. Here, as the experimental result of the localization of sound images made by the applicant of this application, it was turned out that the dip in Hb(α) around 4 kHz to 8 kHz has a great influence on the localization of sound images that the listener perceives in the range where α is in excess of 30°.

Concretely, as shown in FIGS. 5A to 7B, when α is set to α=20°, 30°, 45°, and 60° respectively, a center frequency of the dip in Hb(α) is at 5 kHz, 6 kHz, and 6.5 kHz respectively, and the center frequency of the dip is increased higher as α becomes larger. In this manner, it was turned out that, when the center frequency of the dip is increased higher, the positions of the localization of sound images that the listener can perceive are expanded. In this case, since these dips have some half-value width, the range of dip distributes around 4 kHz to 8 kHz.

The reason why the upper limit is located at 8 kHz may be considered such that, even when α belongs to any range, the large dip exists in the frequency range of 8 kHz or more and as a result the influence on the localization of the sound images is small in that frequency band. In contrast, the reason why the lower limit is located at 4 kHz may be considered such that, the dip exists in the frequency range of 5 kHz±1 kHz when α is at 30° whereas the noticeable dip does not exist in this frequency band when α is at 20° or less. Therefore, it may be considered that the dip in this frequency band has a great influence of an expanding feeling of the localization of sound images. Here, illustration of the frequency characteristic in the range where α is below 20° is omitted, but such frequency characteristic is roughly similar to the frequency characteristic at α=20°.

Figure 1:
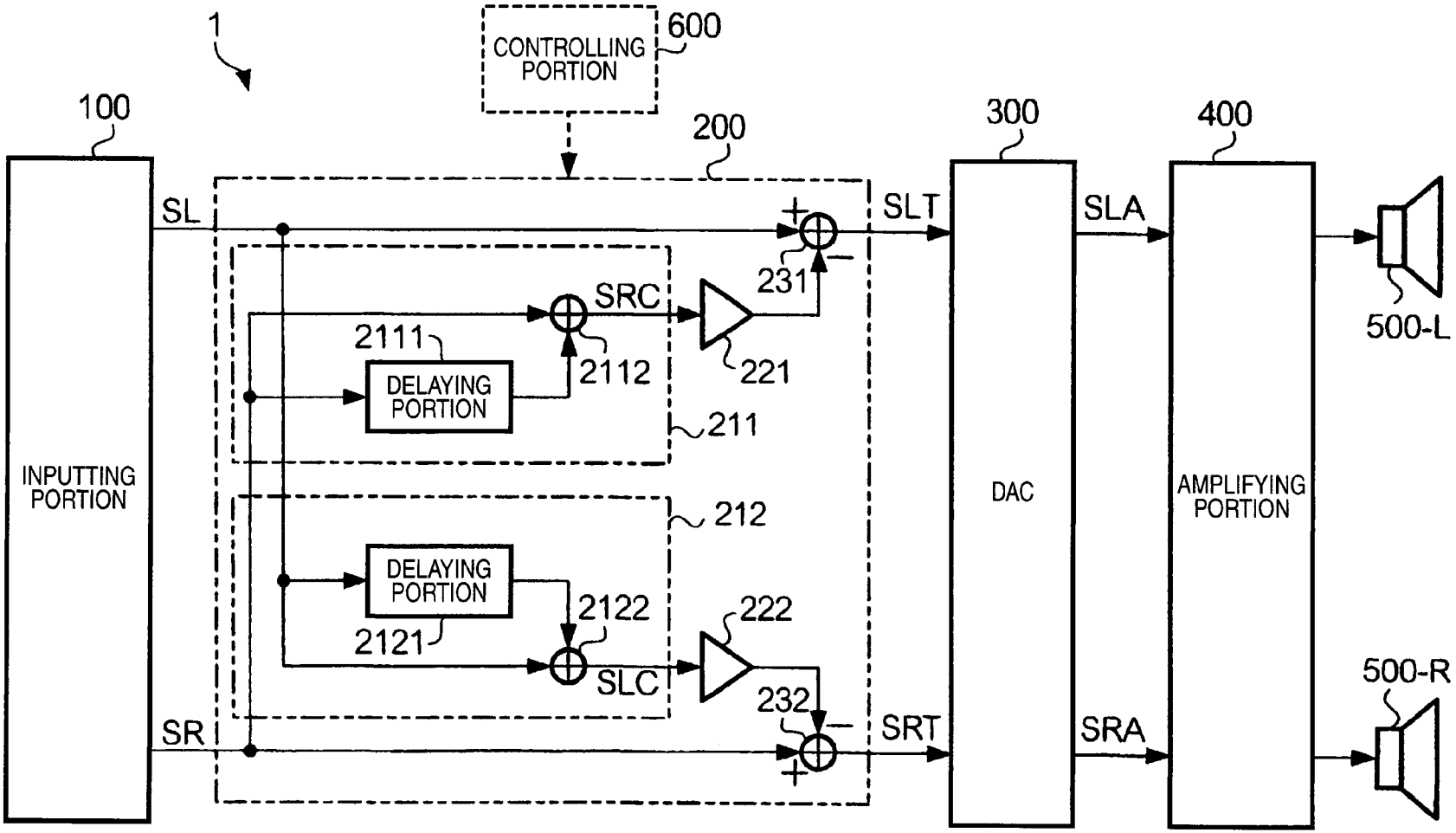
FIG. 1 is a block diagram showing a configuration of a speaker apparatus according to an embodiment of the present invention.

As described above, the speaker apparatus 1 according to the embodiment of the present invention implements the effect of the present invention based on the finding derived from the experiments made by the applicant. A configuration of the speaker apparatus 1 of the present invention will be explained with reference to FIG. 1 hereunder.

An inputting portion 100 inputs the digital audio data, which is supplied from DIR (Digital Interface Receiver), ADC (Analog Digital Converter), or the like and then decoded, into a sound processing portion 200. The audio data being input into the sound processing portion 200 are 2-ch stereo audio data (L-ch audio data is referred to as "audio data SL" hereinafter, and R-ch audio data is referred to as "audio data SR" hereinafter). In this example, it is assumed that the audio data whose sampling frequency is 48 kHz is employed.

The sound processing portion 200 applies the sound process to the input audio data SL, SR. The sound processing portion 200 has an R-ch filter 211, an L-ch filter 212, amplifying portions 221, 222, and adding portions 231, 232. The sound process using the HRTF described above can be implemented simply by the configuration of this sound processing portion 200.

The R-ch filter 211 is a comb filter having a delaying portion 2111, and an adding portion 2112. The R-ch filter 211 receives the audio data SR, applies the filtering process of the predetermined frequency characteristic to the audio data, and outputs audio data SRC. The delaying portion 2111 and the adding portion 2112 constituting the R-ch filter 211 will be explained hereunder.

The delaying portion 2111 applies a delay process with a previously set delay time to the input audio data SR. In this example, this delay time is used to execute the delay process of 4 samples (roughly 83.3 microsecond) of the audio data SR. The adding portion 2112 adds the audio data SR, which was underwent the delay process by the delaying portion 2111, to the audio data SR being input from the inputting portion 100, and then outputs the audio data SRC.

Figure 3:
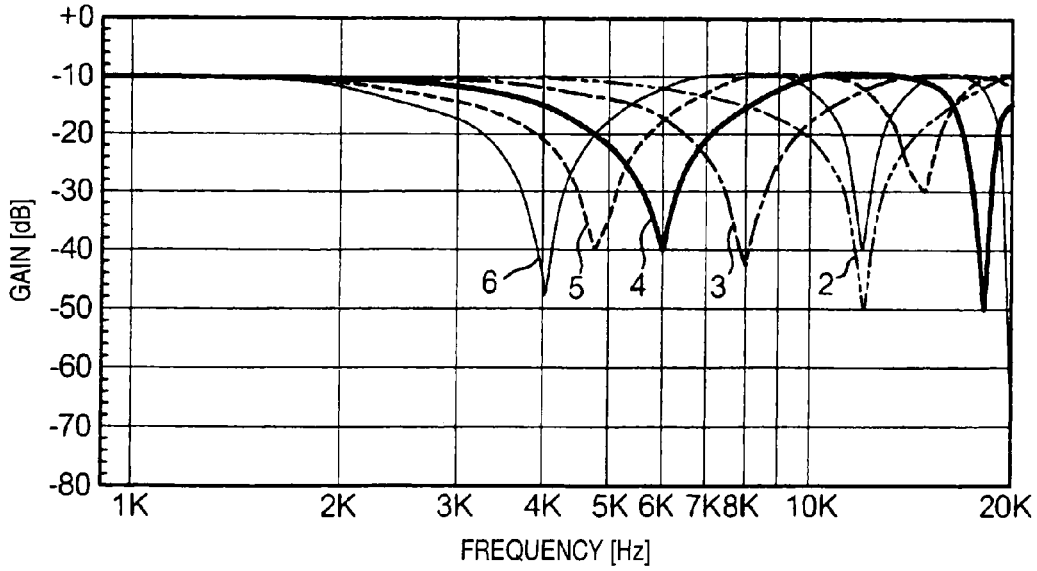
FIG. 3 is an explanatory view showing the frequency characteristic of a comb filter in the embodiment.
Figure 4A:
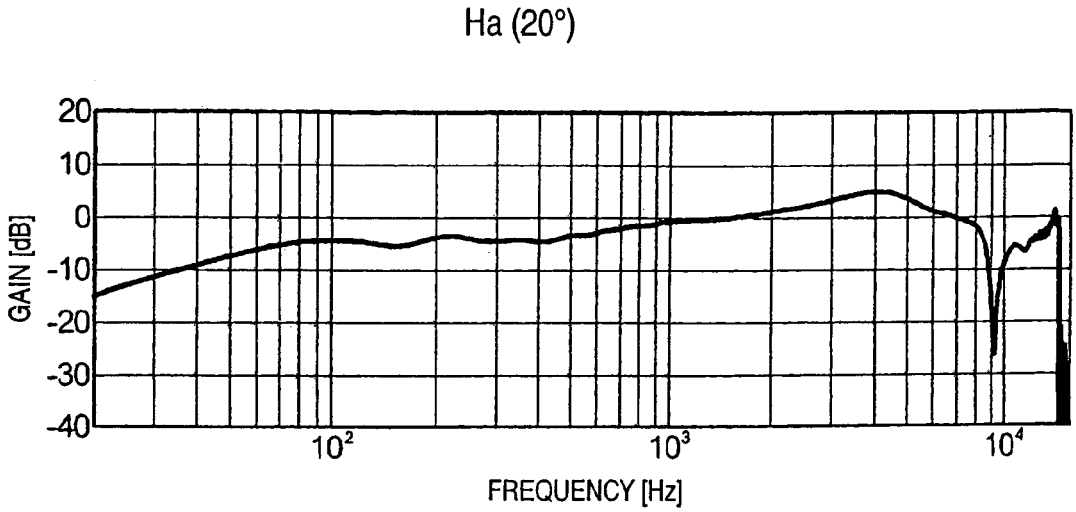
FIGS. 4A and 4B are views showing the frequency characteristic of HRTF at $\alpha$=20°.
Figure 4B:
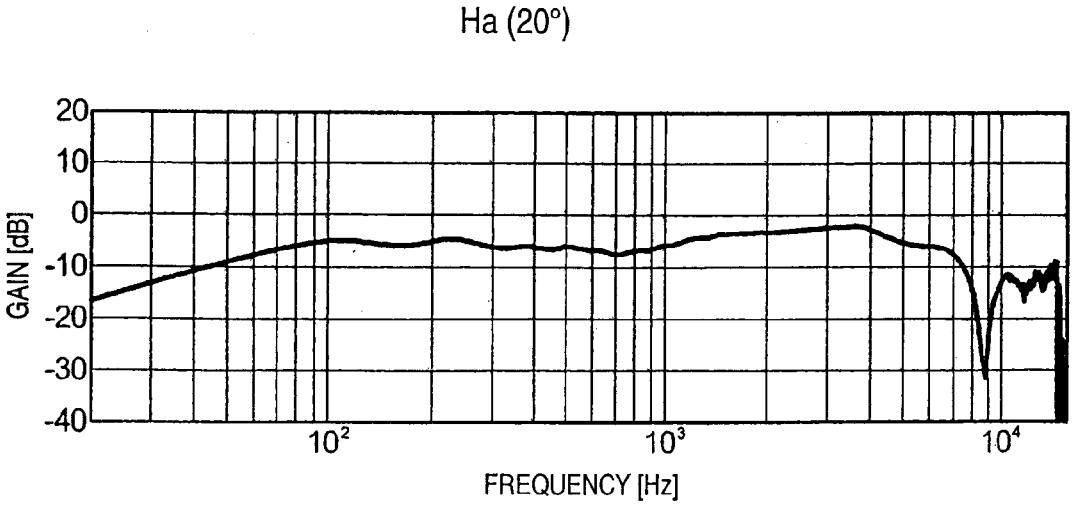
Figure 5A:
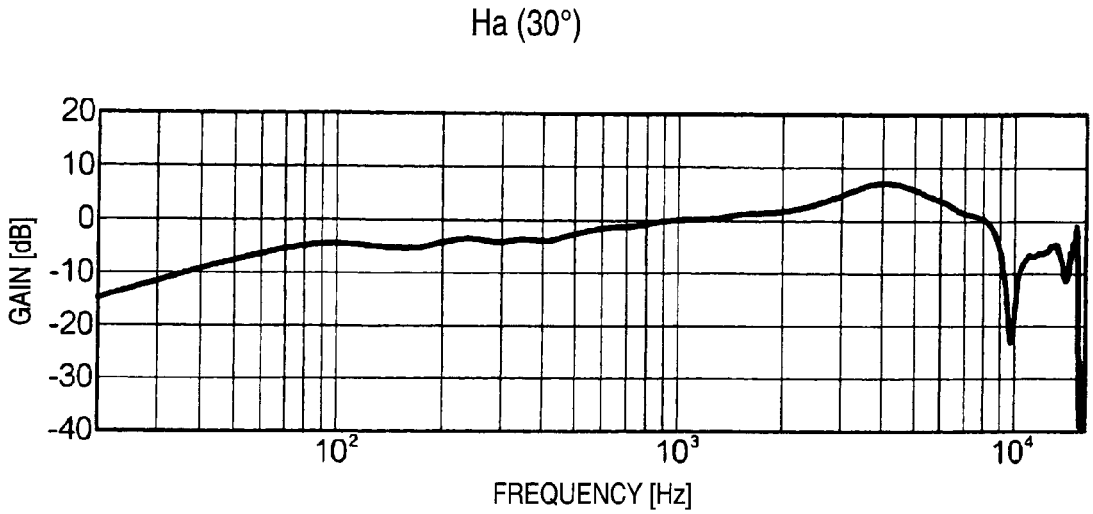
FIGS. 5A and 5B are views showing the frequency characteristic of HRTF at $\alpha$=30°.
Figure 5B:
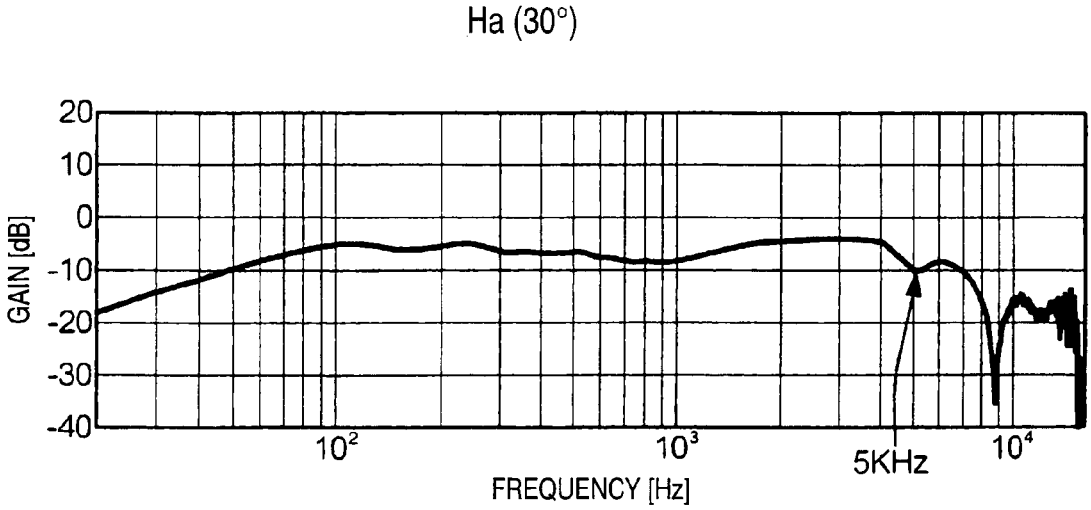
Figure 6A:
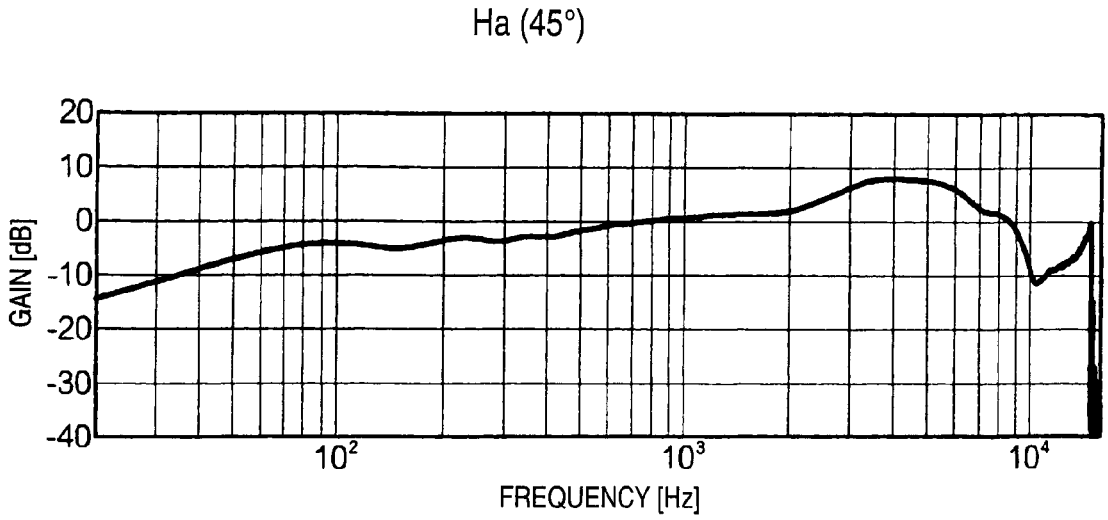
FIGS. 6A and 6B are views showing the frequency characteristic of HRTF at $\alpha$=45°.
Figure 6B:
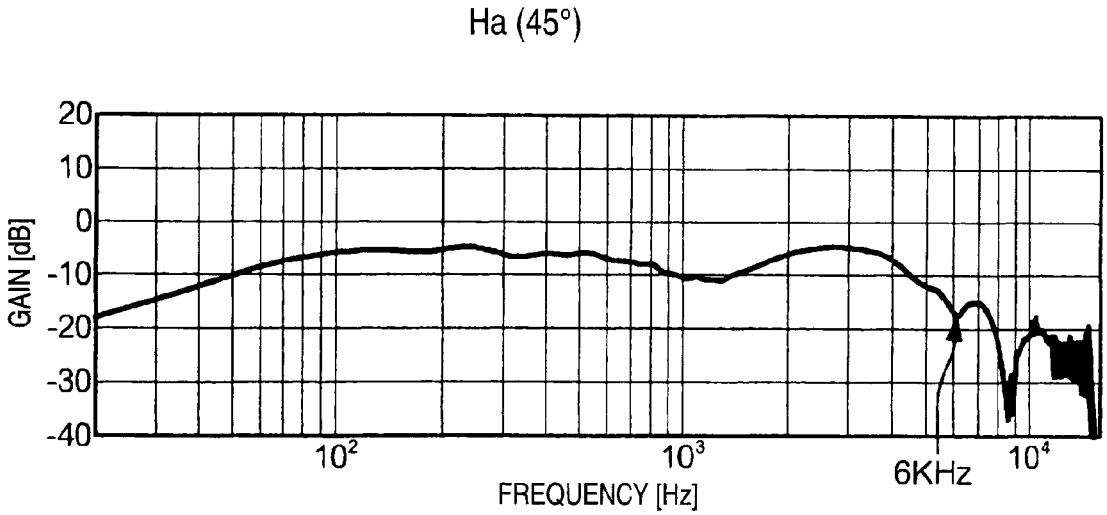
Figure 7A:
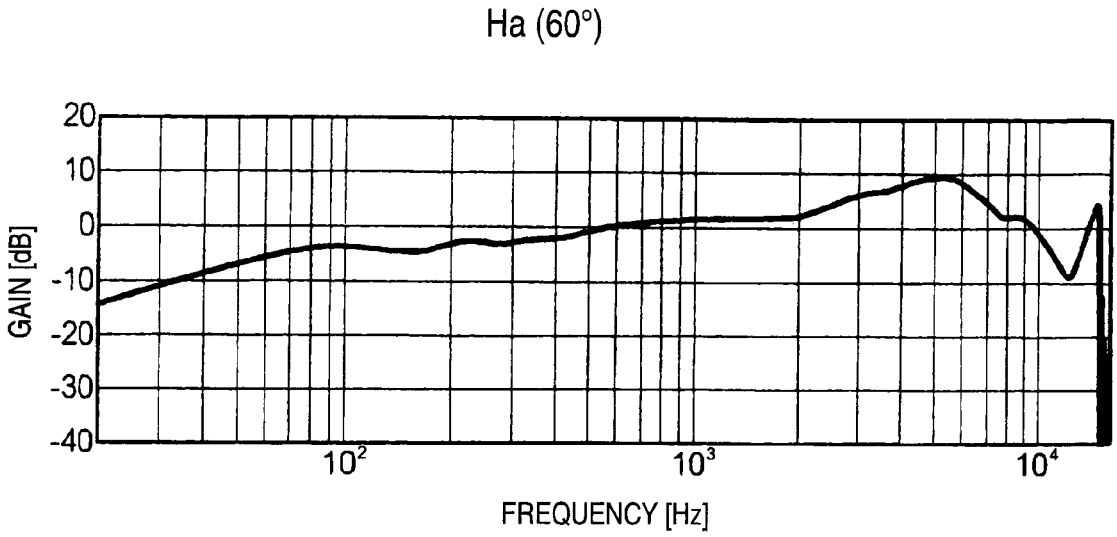
FIGS. 7A and 7B are views showing the frequency characteristic of HRTF at $\alpha$=60°.
Figure 7B:
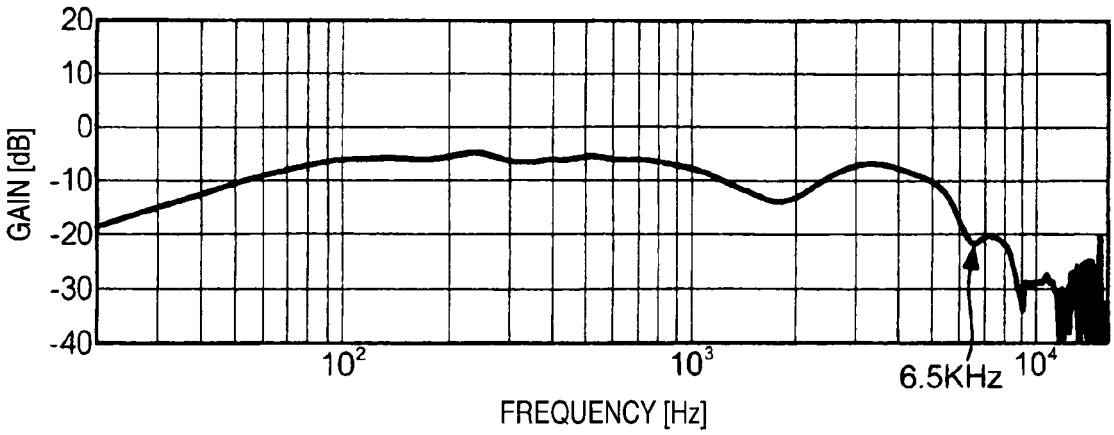

Here, a relationship between a delay time set in the delaying portion 2111 and a frequency characteristic of the filtering process in the R-ch filter 211 as the comb filter will be explained with reference to FIG. 3 hereunder. FIG. 3 is an explanatory view showing the frequency characteristic of the R-ch filter 211 when 2 samples to 6 samples are set as the delay time respectively. Here, the numeral attached to respective frequency characteristics denotes the number of samples being set as the delay time. In this manner, the frequency characteristic has the dip in a predetermined range, and a center frequency of the dip is decided in response to the delay time. A center frequency of the dip in the comb filter is given by Formula (1) as follows.

[Formula 1]

$$DF_n = \frac{2n-1}{2T_d} \tag{1}$$

In Formula (1), DFn denotes a center frequency (Hz) of the dip, and Td denotes a delay time (second) set in the delaying portion 2111, where n=1, 2, 3, . . . .

Like this example, when the delay time Td is set to 4 samples (roughly 83.3 microsecond), the lowest frequency DF1 out of the frequencies of the dips is 6 kHz. In this case, as shown in FIG. 3, the frequency characteristics corresponding to the cases where the delay time Td is set to 2, 3, 4, 5, 6 samples respectively correspond to the frequency characteristics in which the lowest frequency DF1 of the dip is roughly 12, 8, 6, 4.8, 4 KHz respectively.

As described above, the dip ranging from 4 kHz to 8 kHz in the HRTF has a great influence on the localization of the sound images whose center-spread angle is expanded. Therefore, if the lowest frequency DF1 of the dip locates out of this range, the influence of such dip is small. As a result, the delay time Td of in the delaying portion 2111 is set a range from 62.5 microsecond to 125 microsecond (a range from 3 samples to 6 samples when the delay time is represented by the number of samples in this example) such that the lowest frequency DF1 of the dip in the frequency characteristic locates in a range from 4 kHz to 8 kHz.

Here, these dips have a predetermined half-value width respectively. Therefore, when the lowest frequency DF1 of the dip is set in the range from 5 kHz to 6.5 kHz, i.e., the delay time Td is set in the range from 77 microsecond to 100 microsecond, to meet the range of the center frequency of the dip in the HRTF (the range from 5 kHz to 6.5 kHz corresponding to the α ranging from 30° to 60°), an effect of expanding the localization of sound images can be obtained more clearly. In this case, when the delay time is represented by the number of samples, such delay time is limited to 4 samples only. In this situation, when a sampling frequency of the audio data SL, SR is high or when an oversampling processing portion for applying the oversampling to the audio data SL, SR being input into the sound processing portion 200 to increase the sampling frequency is provided, the delay time Td can be adjusted finely within the set range.

In this example, the R-ch filter 211 applies the filtering process, which has a center frequency of the dip at 6 kHz, to the input audio data SR. Therefore, the output audio data SRC has a frequency distribution whose output level located around 6 kHz is lowered rather than the audio data SR. In this manner, when the sound is emitted from the speakers 500-L, 500-R after the center frequency of the dip is provided at 6 kHz in the frequency characteristic and also the process described later is applied, the sound images can be localized such that the sound is emitted from the virtual speakers 501-L, 500-R between which the one-side angle β is set to 45°. With the above, explanation of the R-ch filter 211 is completed.

Here, the L-ch filter 212 is the comb filter that has a delaying portion 2121, and an adding portion 2122, and receives the audio data SL, applies the filtering process having the predetermined frequency characteristic, and outputs the audio data SLC. But its configuration is similar to the configuration of the R-ch filter 211, and therefore their explanation will be omitted herein.

The amplifying portion 221 amplifies the audio data SRC output from the R-ch filter 211 at an amplification factor that is set in advance, and adjusts an output level. Also, the amplifying portion 222 amplifies the audio data SLC output from the L-ch filter 212 at an amplification factor that is set in advance, and adjusts an output level. Accordingly, a level difference between the dip caused by applying the filtering process in the R-ch filter 211 and the L-ch filter 212 and the dip in the difference of the HRTF should be adjusted. In this example, an amplification factor is set such that the output level should be adjusted in response to the level that corresponds to the difference between Hb (20°) and Hb (45°). Here, the influence imposed on the localization of sound images by this level adjustment is slight. Unless the output levels are made different largely, no adjustment that makes both levels coincide with each other with high precision is needed.

The adding portion 231 adds the audio data SRC being amplified by the amplifying portion 221 to the audio data SL being output from the inputting portion 100, and outputs audio data SLT. In this addition, the audio data SL is adjusted in phase by inverting a phase of the audio data SRC to be added, or the like such that this audio data SL has an inverted phase to the audio data SR that is added by the adding portion 232.

The adding portion 232 adds the audio data SLC being amplified by the amplifying portion 222 to the audio data SR being output from the inputting portion 100, and outputs audio data SRT. In this addition, the audio data SR is adjusted in phase by inverting a phase of the audio data SLC to be added, or the like such that this audio data SR has an inverted phase to the audio data SL that is added by the adding portion 231.

In this manner, the sound processing portion 200 applies the sound process to the input audio data SL, SR, and outputs the audio data SLT, SRT. With the above, explanation of the sound processing portion 200 is completed.

A DAC 300 is a digital-analog converter, and converts the audio data SLT, SRT being output from the sound processing portion 200 into analog signals and then outputs the audio signals SLA, SRA.

An amplifying portion 400 is a preamplifier and a power amplifier, and amplifies the audio signals SLA, SRA output from the DAC 300. The amplifying portion 400 outputs the amplified audio signals SLA, SRA to the speakers 500-L, 500-R respectively, and causes the speakers to emit the sound.

In this manner, when the audio signal SLA is emitted from the speaker 500-L and also the audio signal SRA is emitted from the speaker 500-R, the listener 1000 located as shown in FIG. 2 can feel as if the sound images of the audio signals SLA, SRA are localized in the direction at the one-side angle β=45° respectively, and can perceive such that the sound is emitted from the virtual speakers 501-L, 501-R respectively.

In this manner, the speaker apparatus 1 according to the embodiment of the present invention attaches the dip in vicinity of 4 kHz to 8 kHz by applying the filtering process, which has the small process load, to the audio data on one channel with the simple configuration like the comb filter using the delay corresponding to several samples, and also performs the sound process added to the audio data on the other channel by adjusting the phase. Also, since the sound is emitted based on the audio data that are subjected to such sound process respectively, the speaker 500-L and the speaker 500-R of the speaker apparatus 1 can be provided at the close locations. Even though the center-spread angle from the listener 1000 is narrow, the listener 1000 can feel as if the sound is emitted from the virtual speakers 501-L, 501-R between which the larger center-spread angle is held respectively, and can perceive such that the positions of sound image are expanded.

Also, since the frequency characteristic of the comb filter is constructed by providing the dip in a part of the frequencies, such frequency characteristic has the robust performance that is more stable than that using the HRTF. Therefore, the listener who has a different shape of the head from that used in forming the HRTF can obtain an expanding feeling of the positions of sound images without a strange feeling, and the listener can expand the range of audible positions where the listener can obtain an expanding feeling of the positions of sound images.

The embodiment of the present invention is explained as above. But the present invention can be carried out in various modes described as follows.

<Variation 1>

In the above embodiment, the phase adjustment in the adding portions 231, 232 of the sound processing portion 200 is made to get the inverted phase relationship respectively. The inverted phase relationship is not always needed. This phase adjustment is made to prevent such a situation that the sound images are localized between the speakers 500-L, 500-R due to the correlation between the component of the audio data SL contained in the audio signal SLA that is emitted from the speaker 500-L and the component of the audio data SLC contained in the audio signal SRA that is emitted from the speaker 500-R.

Accordingly, in order to prevent such localization, at least the audio data SL and the audio data SLC should not have the in-phase relationship. In this manner, the adding portions 231, 232 may adjust the phase such that the relationship in phase between the audio data SL and the audio data SLC and the relationship in phase between the audio data SR and the audio data SRC should have not only the inverted phase relationship but also the mutually different relationship. At this time, the phase adjustment may be made by using the all-pass filter, or the like. In this case, since commonly the phase information that the listener 1000 can perceive is in the frequency band of 1 kHz or less, the phase in the frequency band of 1 kHz or less instead of the full frequency band may be adjusted.

<Variation 2>

In the above embodiment, the delay time set in the delaying portions 2111, 2121 of the sound processing portion 200 may be changed. In this case, as indicated with a broken line in FIG. 1, a controlling portion 600 may be provided. The controlling portion 600 decides a delay time that is to be set in the delaying portions 2111, 2121, and sets the decided delay time. This instruction may be issued when the listener 1000 operates an operating portion (not shown), and may instruct the speaker apparatus 1 to expand or narrow the positions of sound images. The controlling portion 600 may decide the delay time Td as a predetermined time that is shorter than the existing setting when the instruction to expand the positions of sound images is issued, and may conversely decide the delay time Td as a predetermined time that is longer than the existing setting when the instruction to narrow the positions of sound images is issued. In this manner, the lowest frequency DF1 of the dip is made higher when the delay time Td is set shorter, while the lowest frequency DF1 of the dip is made lower when the delay time Td is set longer. Therefore, an expanding feeling of the localization of sound images that the listener 1000 desires can be achieved.

In this case, as described above, the desired time is decided in the setting range of the delay time Td, i.e., in the range from 62.5 microsecond to 125 microsecond. For example, when the desired time is set to 125 microseconds, the delay time Td to be set is never prolonged even though the instruction to narrow the positions is issued. At this time, the listener 1000 may be informed of this error by an alarm, or the like.

Also, the controlling portion 600 may not only change the setting of the delay time but also control the change of various parameters to be set. For example, change of an amplification factor set in the amplifying portions 221, 222, change of phase adjustment amount in the adding portions 231, 232, and the like may be applied.

<Variation 3>

In the above embodiment, the comb filter is employed as the R-ch filter 211 and the L-ch filter 212. The notch filter, the parametric equalizer, etc. are employed to act as the filter having the frequency characteristic in which the lowest frequency of the dip is set previously in the frequency range from 4 kHz to 8 kHz.

<Variation 4>

In the above embodiment, the present invention is explained by reference to the speaker apparatus 1 as an embodiment. In this case, the object of the present invention can be attained by reference to the sound processing device having the configuration of the sound processing portion 200. Such sound processing device is applicable to various electric equipments such as cellular phone, television, AV amplifier, and the like having two speakers or more that can reproduce the sound in stereo.

<Variation 5>

In the above embodiment, the case where respective constituent elements are constructed by the hardware is explained. In this event, a part or all of functions of the sound processing portion 200 may be implemented when the CPU of the computer (not shown), which is equipped with the inputting portion 100, the DAC 300, the amplifying portion 400, and the speakers 500-L, 500-R, executes the sound processing program stored in the memory portion. Such sound processing program can be provided in a condition that this program is stored in a computer-readable recording medium such as magnetic recording medium (magnetic tape, magnetic disc, or the like), optical recording medium (optical disc, or the like), magneto-optic recording medium, semiconductor memory, or the like. In this case, a reading portion for reading the recording medium may be provided. Also, the sound processing program may be downloaded via the network such as the Internet.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-152041 filed on Jun. 10, 2008, the contents of which are incorporated herein for reference.

What is claimed is:

1. A sound processing device comprising:

an inputting section that inputs L-ch audio data and R-ch audio data;

a delaying section that delays the L-ch audio data and the R-ch audio data by a delay time ranging from 62.5 microsecond to 125 microsecond;

a first adding section that adds the L-ch audio data delayed by the delaying section to the L-ch audio data input by the inputting section;

a second adding section that adds the R-ch audio data delayed by the delaying section to the R-ch audio data input by the inputting section;

a first phase adjusting section that adjusts a phase of the L-ch audio data added by the adding section into a phase that is inverted in phase from a phase of the L-ch audio data input by the inputting section;

a second phase adjusting section that adjusts a phase of the R-ch audio data added by the adding section into a phase that is inverted in phase from a phase of the R-ch audio data being input by the inputting section;

a first outputting section that adds the L-ch audio data whose phase is adjusted by the first phase adjusting section to the R-ch audio data input by the inputting section and outputs resultant R-ch audio data; and a second outputting section that adds the R-ch audio data whose phase is adjusted by the second phase adjusting section to the L-ch audio data input by the inputting section and outputs resultant L-ch audio data.

2. The sound processing device according to claim 1, further comprising a controlling section that decides the delay time being set in the delaying section, in response to an instruction.

3. The sound processing device according to claim 1, further comprising:

a filter processing section that has a frequency characteristic in which a lowest frequency of a dip is set in a range from 4 kHz to 8 kHz, and filters the L-ch audio data and the R-ch audio data, wherein the filter processing section includes the delay section, wherein the first phase adjusting section adjusts the phase of the L-ch audio data, which has been filtered by the filter processing section, and wherein the second phase adjusting section adjusts the phase of the R-ch audio data, which has been filtered by the filter processing section.

4. The sound processing device according to claim 3, wherein the filter processing section includes one of a comb filter, a notch filter, or a parametric equalizer.

5. A speaker apparatus comprising:

the sound processing device set forth in claim 1;

a converting section that converts the output resultant R-ch audio data and the output resultant L-ch audio data into analog signals, and outputs an analog R-ch audio signal and an analog L-ch audio signal;

an amplifying section that amplifies the analog R-ch audio signal and the analog L-ch audio signal; and an L-ch speaker and an R-ch speaker that respectively emit the analog R-ch audio signal and the analog L-ch audio signal amplified by the amplifying section.

6. A speaker apparatus comprising:

the sound processing device set forth in claim 3;

a converting section that converts the resultant R-ch audio data and the resultant L-ch audio data into analog signals, and outputs an analog R-ch audio signal and an analog L-ch audio signal;

an amplifying section that amplifies the analog R-ch audio signal and the analog L-ch audio signal; and an L-ch speaker and an R-ch speaker that respectively emit the analog R-ch audio signal and the analog L-ch audio signal amplified by the amplifying section.

7. A sound processing method comprising the steps of:

an inputting step of inputting L-ch audio data and R-ch audio data;

a delaying step of delaying the L-ch audio data and the R-ch audio data by a delay time ranging from 62.5 microsecond to 125 microsecond;

an adding step of adding the L-ch audio data delayed in the delaying step to the L-ch audio data input in the inputting step, and adding the R-ch audio data delayed in the delaying step to the R-ch audio data input in the inputting step;

a phase adjusting step of adjusting a phase of the L-ch audio data added in the adding step into a phase that is inverted in phase from a phase of the L-ch audio data input in the inputting step, and adjusting a phase of the R-ch audio data added in the adding step into a phase that is inverted in phase from a phase of the R-ch audio data input in the inputting step; and an outputting step of adding the L-ch audio data whose phase is adjusted in the phase adjusting step to the R-ch audio data input in the inputting step and outputting resultant R-ch data, and adding the R-ch audio data whose phase is adjusted in the phase adjusting step to the L-ch audio data input in the inputting step and outputting resultant R-ch data.

8. The sound processing method according to claim 7, further comprising:

a filter processing step of filtering the L-ch audio data and the R-ch audio data with a filter having a frequency characteristic in which a lowest frequency of a dip is set in a range from 4 kHz to 8 kHz, wherein the phase adjusting adjusts the phase of the L-ch audio data, which has been filtered in the filter processing step, and adjusts the phase of the R-ch audio data, which has been filtered in the filter processing step.

* * * * *